US005504665A

United States Patent [19]

Osteen et al.

[11] Patent Number: 5,504,665

[45] Date of Patent: Apr. 2, 1996

[54] QUARTZ-HALOGEN FLOODLIGHT WITH MOUNTING MEANS CAPABLE OF ADJUSTING FLOODLIGHT BOTH VERTICALLY AND HORIZONTALLY

[75] Inventors: Mitchell M. Osteen, Zirconia; Suleyman O. Sumer, Chapel Hill, both of N.C.

[73] Assignee: Regent Lighting Corporation, Burlington, N.C.

[21] Appl. No.: 305,055

[22] Filed: Sep. 13, 1994

[51] Int. Cl.[6] ..... F21V 21/29

[52] U.S. Cl. ..... 362/287; 362/269; 362/419; 362/371; 362/427; 362/275

[58] Field of Search ..... 362/287, 285, 362/413, 418, 371, 275, 419, 427, 269, 270, 217, 260, 273, 804

[56] References Cited

U.S. PATENT DOCUMENTS

| | | | |
|---|---|---|---|
| 2,426,436 | 8/1947 | Cochener | 362/371 |
| 2,458,967 | 1/1949 | Wiedenhoeft | 362/419 X |
| 3,240,925 | 3/1966 | Paschke et al. | 362/275 X |
| 3,965,346 | 6/1976 | Thompson, Jr. | 362/371 |
| 4,470,106 | 9/1984 | Norton | 362/398 X |
| 4,727,460 | 2/1988 | Payne | 362/371 X |
| 4,931,917 | 6/1990 | Scherf et al. | 362/371 |

*Primary Examiner*—Ira S. Lazarus
*Assistant Examiner*—Thomas M. Sember

[57] ABSTRACT

This quartz-halogen floodlight includes mounting means that is so constructed that the light-aiming angle of the floodlight can be adjusted both horizontally and vertically without disturbing the normal horizontal disposition of the quartz-halogen lamp within the floodlight.

3 Claims, 3 Drawing Sheets

QUARTZ-HALOGEN FLOODLIGHT WITH MOUNTING MEANS CAPABLE OF ADJUSTING FLOODLIGHT BOTH VERTICALLY AND HORIZONTALLY

TECHNICAL FIELD

This invention relates to a floodlight that includes as its light source a quartz-halogen lamp comprising a tubular light-transmitting envelope having a longitudinal axis and a filament extending along such axis.

BACKGROUND

It has long been recognized that it is important in lighting fixtures that employ the above type of quartz-halogen lamp that the longitudinal axis of the lamp envelope be disposed substantially horizontally. Such horizontal disposition is needed in order to achieve a long life and good lumen maintenance from the lamp, partially because of thermal considerations and partially because of the role of the horizontal disposition in assuring correct operation of the halogen cycle.

One of the major applications for quartz-halogen lamps is in small floodlights, which typically use a trough-like, horizontally-oriented reflector, with the lamp suitably placed in the trough for the desired light distribution. The floodlight is generally equipped with a support stem having external threads on its open end for threaded engagement with an internally-threaded hole in suitable support structure, e.g., a conduit fitting on the side of a building or a pole-mounted bracket. In the usual mounting arrangement, the support stem extends horizontally.

In residential lighting applications, the typical mounting arrangement for the floodlight includes the above-described horizontally-extending, externally-threaded support stem and a cast cover for the typical wiring box used on houses or garages. The horizontally-extending support stem is threaded into an internally-threaded hole in the cast cover. The floodlight is usually equipped with a pivot joint, or knuckle, for adjustably supporting the floodlight housing on the support stem. This knuckle typically allows the floodlight housing to be adjusted for vertical movement, i.e., pivotal motion about a horizontal axis so as to provide for vertical adjustments of its light-aiming angle. But there is no provision in such mounting arrangements for adjustment about a vertical axis, i.e., horizontal adjustments of the light-aiming angle. While it is possible to make certain adjustments in orientation of the floodlight by further screwing the support stem into the cast cover by a partial turn and then locking it in place, this is not an acceptable way of adjusting a quartz-halogen type of floodlight because it causes the quartz-halogen lamp within the floodlight to be tilted out of its required horizontal disposition.

OBJECTS

An object of our invention is to provide inexpensive mounting means for a quartz-halogen floodlight which provides for both vertical and horizontal adjustments of the floodlight housing and allows the quartz-halogen lamp to remain horizontal despite such adjustments.

Another object is to construct the mounting means for a quartz-halogen floodlight in such a way that the normally horizontally-disposed lamp of the floodlight remains horizontally disposed despite adjustments of the floodlight housing about both a horizontal axis and a vertical axis.

Another object is to provide a simple, easily-manufactured modification of the conventional mounting means for quartz-halogen floodlights, the inclusion of which enables the mounting means to provide for both horizontal and vertical adjustments without disturbing the normally horizontal disposition of the quartz-halogen lamp.

SUMMARY

In carrying out the invention in one form, we provide a quartz-halogen floodlight comprising a housing, a reflector within the housing, and socket means for mounting on a first reference axis within the reflector a quartz-halogen lamp of the type that comprises an elongated tubular envelope having a longitudinal axis adapted to extend along said first reference axis and a filament within said envelope extending longitudinally of the envelope. On the floodlight housing is mounting structure that allows the housing to be pivoted about a second reference axis that is substantially parallel to said first reference axis. For supporting the housing, there is provided an elongated support stem having a longitudinal axis adapted to be disposed horizontally and an intermediate link between said support stem and said mounting structure. The intermediate link is mounted on the support stem by a pivot joint that allows the intermediate link to be rotationally adjusted about a support axis that extends substantially perpendicular to the longitudinal axis of the support stem; and said mounting means is mounted on the intermediate link by a pivot joint that positions said second reference axis substantially perpendicular to said support axis and allows the floodlight housing to be rotationally adjusted about said second reference axis.

BRIEF DESCRIPTION OF FIGURES

For a better understanding of the invention, reference may be had to the following detailed description taken in connection with the accompanying drawings, wherein:

In FIG. 8, the lug 72 and screw 84 of FIG. 7 are omitted for clarity.

DETAILED DESCRIPTION OF EMBODIMENTS

Figure 1:
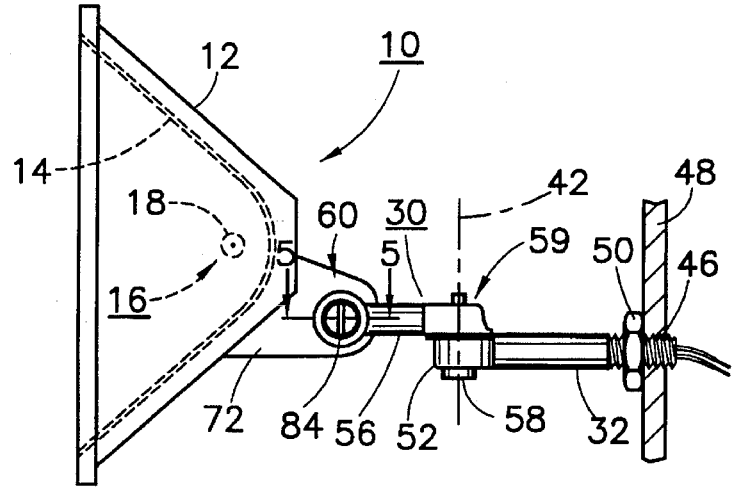
FIG. 1 is a side-elevational view of quartz-halogen floodlight embodying one form of our invention.
Figure 2:
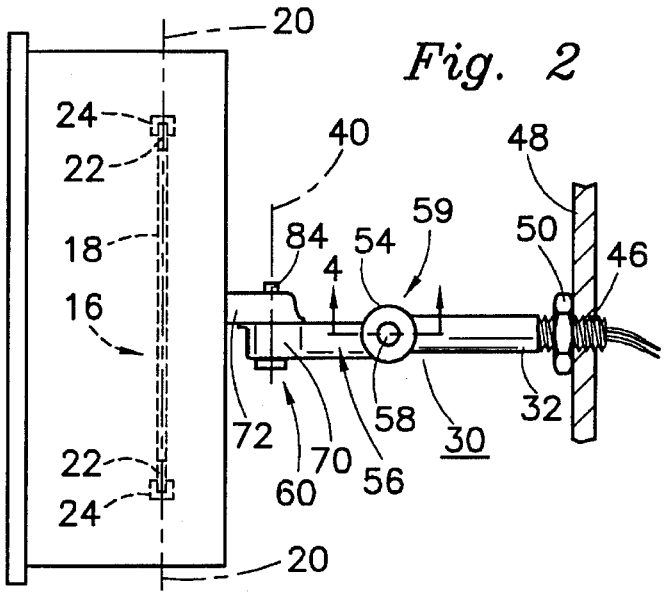
FIG. 2 is a plan view of the floodlight of FIG. 1.
Figure 3:
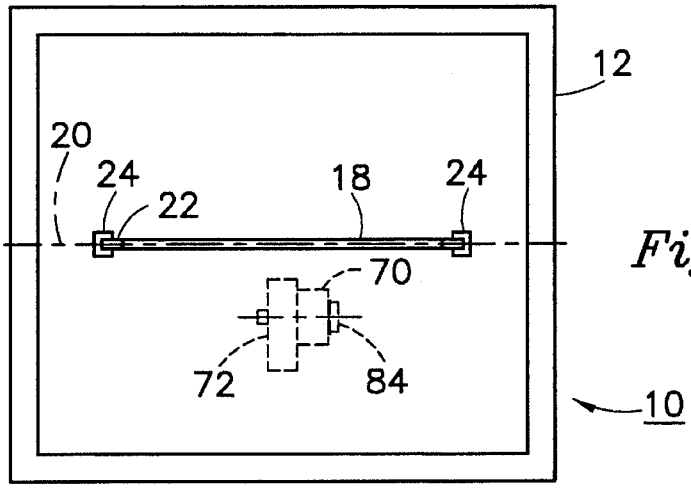
FIG. 3 is a front view of the floodlight of FIGS. 1 and 2.

Referring now to FIGS. 1–3, the illustrated floodlight 10 comprises a housing 12 and a trough-shaped reflector 14 mounted therein. Mounted within the reflector 14 is a light source in the form of a double-ended quartz-halogen lamp 16. This lamp, which is of conventional form, comprises a horizontally-extending tubular envelope 18 having a central axis 20 that extends longitudinally of the tubular envelope, conductive terminals 22 at opposite ends of the envelope, and a filament within the envelope connected between the terminals and extending along the central axis of the envelope. The envelope 18 is a sealed envelope filled with a halogen-containing gas. The terminals of the lamp are mounted within conductive sockets 24 that are so located that the central longitudinal axis 20 of the lamp extends substantially horizontally. As pointed out hereinabove under "Background", it is important that the this longitudinal axis be maintained in a horizontal position during lamp operation in order to achieve long life and good lumen maintenance from the lamp.

Figure 6:
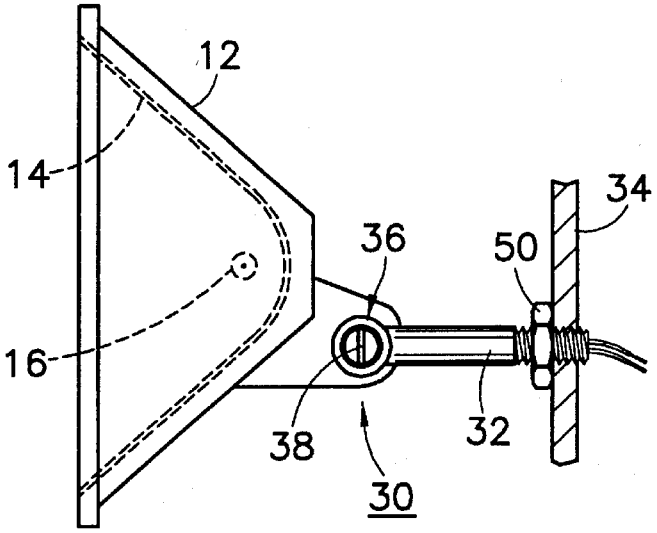
Fig. 6 PRIOR ART
FIG. 6 is a side elevational view similar to FIG. 1 of a prior-art quartz-halogen floodlight.

The floodlight of FIGS. 1–3 includes mounting means 30 which is constructed to allow its housing, and, hence, the light-aiming angle of the floodlight, to be adjusted in both a vertical direction and a horizontal direction, as will soon be explained in greater detail. In the typical prior art floodlight, shown in FIG. 6, the mounting means 30 for the floodlight has allowed the housing to be adjusted in a vertical direction but has not allowed for horizontal adjustment of an acceptable character. More specifically, the prior art floodlight of FIG. 6 has included a support stem 32 having external threads which are threaded into a conduit cover or the like, such as shown at 34. The stem 32 has typically extended horizontally, and between the floodlight housing 12 and the stem 32 there is a pivot joint, or knuckle, (36) that has allowed the housing to be pivoted about a horizontal pivot axis 38 defined by the knuckle. The mounting means 30 of FIG. 6 has allowed no acceptable horizontal adjustment of the floodlight. While it is possible to make adjustments in the prior art floodlight of FIG. 6 by screwing the stem 32 further into the cover 34 by a partial turn and then locking the stem in this position (as by a lock nut 50), this is not an acceptable way of adjusting a quartz-halogen floodlight because it tilts the axis of the quartz-halogen lamp out of its required horizontal position.

We have constructed the mounting means 30 of the floodlight of FIGS. 1–3 in such a manner that the housing 12 of the floodlight can be adjusted not only vertically but also horizontally. Vertical adjustments are effected by pivoting the housing 12 about a reference axis 40 that is disposed parallel to the axis 20 of the lamp envelope, as best shown in FIG. 2; and horizontal adjustments are effected by pivoting the housing 12 about a second reference axis 42 that is disposed perpendicular to the first reference axis 40. This second reference axis, which is best shown in FIG. 1, is sometimes referred to herein as a support axis.

The mounting means 30 of the floodlight of FIGS. 1–3 comprises a hollow support stem 32 that extends in a horizontal direction into an opening 46 in a wiring-box cover 48. The support stem 32 has on its right-hand end external threads that engage internal threads on the cover 48 surrounding the opening 46. A suitable lock nut 50 is provided on the threaded inner end of the support stem 32 for locking the support stem in its position of FIGS. 1 and 2 within cover 48.

The left-hand end of the support stem 32 includes a flattened generally annular portion 52 on which the right hand end of an intermediate link 56 is pivotally mounted. Referring to FIG. 2 and the enlarged sectional view of FIG. 4, the right-hand end of the intermediate link 56 includes a flattened generally annular position 54 that aligns with the generally annular portion 52 of the support stem 32. The immediately adjacent walls of portions 52 and 54 contain circular openings that are disposed in alignment. A circular flange 55 around the opening in portion 52 fits into the circular opening in portion 54 and acts as a pivot surrounding the support axis 42 to allow portion 54 to be rotatably adjusted about the support axis 42. In their outer walls, portions 52 and 54 contain aligned holes through which a clamping screw, or pin 58 extends. The hole in portion 54 includes internal threads for receiving the external threads of clamping screw 58. When intermediate link 56 has been pivoted about axis 42 to the desired position of adjustment, the screw 58 is tightened to lock the intermediate link 56 in this position with respect to the support stem 32. The structure of FIG. 4 can be thought of as a pivot joint, or knuckle, 59 establishing the support axis 42.

Figure 5:
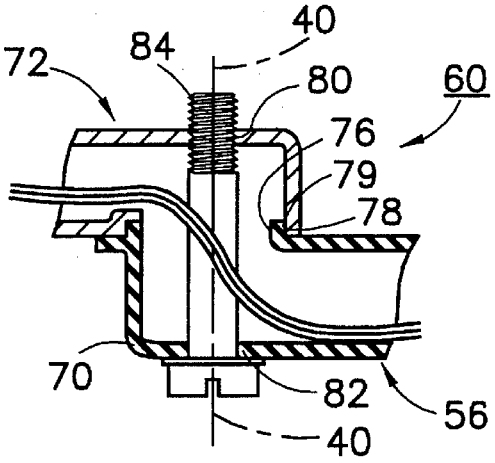
FIG. 5 is an enlarged sectional view of another pivot joint contained in the floodlight of FIGS. 1–3, taken along the line 5—5 of FIG. 1.

The floodlight mounting means 30 further comprises an additional pivot joint 60 that establishes the previously referred-to reference axis 40, which is perpendicular to the support axis 42 and is parallel to the lamp axis 20. Referring to FIGS. 1, 2, and 5, pivot joint 60 is located at the left-hand end of the intermediate link 56 and comprises a flattened, generally-annular portion 70 on link 56 having a major plane disposed perpendicular to the major plane of the other pivot joint 59. The pivot joint 60 also includes a rearwardly-projecting hollow lug 72 forming a part of the floodlight housing 12. In one sidewall of the lug 72 is a circular opening 78 that is disposed in alignment with circular opening 76 in the flattened portion 70 of the intermediate link. A circular flange 79 on the portion 70 loosely fits into the circular opening 78 to provide a pivot for the lug 72 to enable the lug to be rotatably adjusted about axis 40. The lug 72 contains a threaded opening 80 in its opposite sidewall, and this opening aligns with an opening 82 in one wall of the flattened portion 70 of the intermediate link 56. A clamping screw, or pin 84 extends through these openings, engages the threads in opening 82, and can be tightened to clamp the lug 72 in a desired position of adjustment with respect to the intermediate link 56.

If it is desired to adjust the floodlight housing 12 in a vertical direction, i.e., about the horizontal reference axis 40, this is accomplished by loosening clamping screw 84 and pivoting the housing about the reference axis 40, following which the clamping screw is tightened to lock the housing 12 in its desired position of adjustment. If it is desired to adjust the floodlight housing 12 in a horizontal direction, i.e., about the vertical support axis 42, this is accomplished by loosening clamping screw 58 and pivoting the clamped-together housing 12 and intermediate link 56 about the support axis 42. It is important to note that each of these adjustments can be made without disturbing the normal horizontal disposition of the quartz-halogen lamp 16 following these adjustments.

Figure 4:
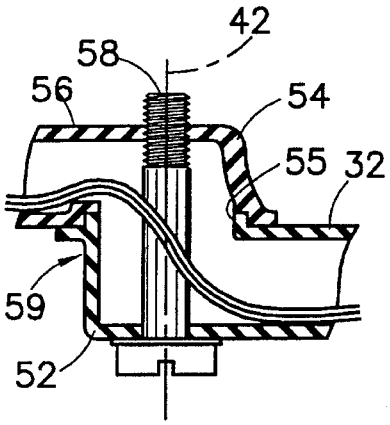
FIG. 4 is an enlarged sectional view of one of the pivot joints in the floodlight of FIGS. 1–3, taken along the line 4—4 of FIG. 2.

The mounting means 30 serves the additional function of enclosing the insulation-covered, power supply wires leading to and from the lamp 16. In this respect, note that the support stem 32, the intermediate link 56, and the lug 72 are all of a hollow construction, as shown in FIGS. 4 and 5, and this provides a passage through each component that enables it to function as a wire way. The wires are able to freely pass between the components without exposure to the surrounding ambient because the pivot joints 59 and 60 each include in the juxtaposed walls of their components aligned openings through which the wires can freely pass, as shown in FIGS. 4 and 5.

Figure 7:
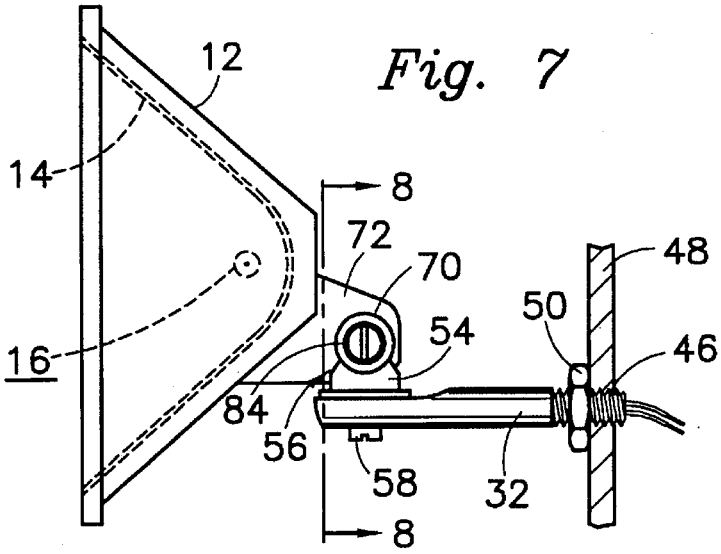
FIG. 7 is a side elevational view of a floodlight embodying a modified form of the invention.
Figure 8:
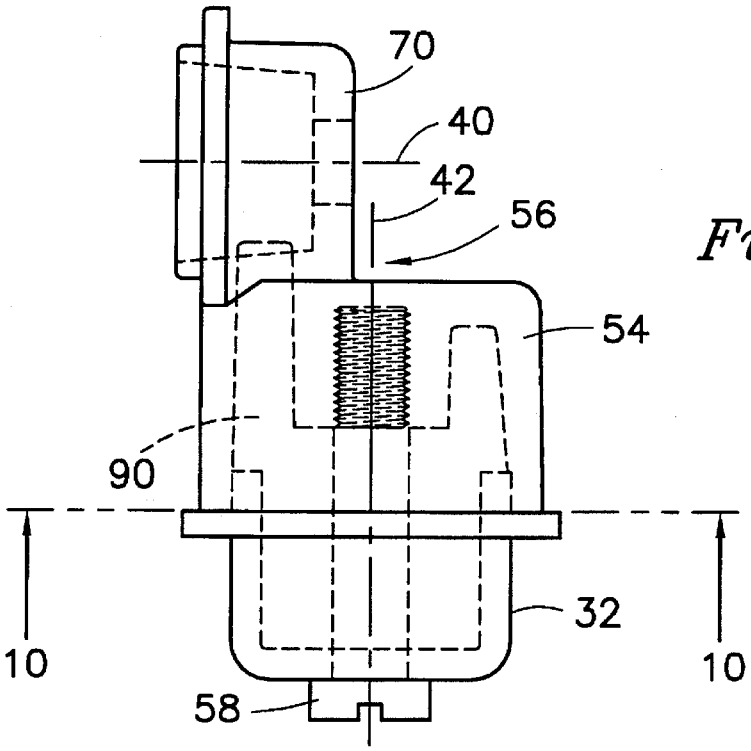
FIG. 8 is an enlarged side view of several components of the floodlight of FIG. 7, looking in the direction of arrows 8—8 of FIG. 7.
Figure 10:
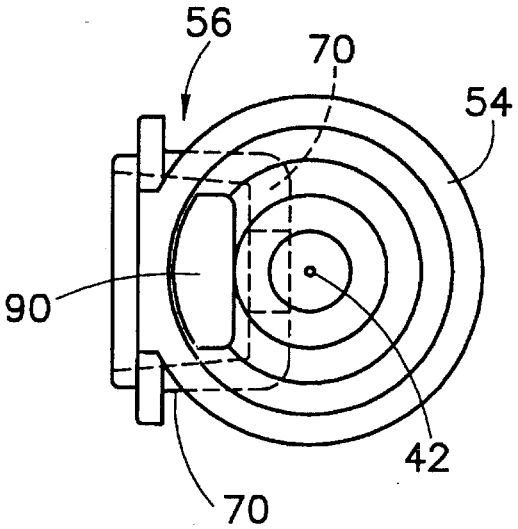
FIG. 10 is a bottom plan view of the component of FIG. 9 taken along the line 10—10 of FIG. 8.
Figure 9:
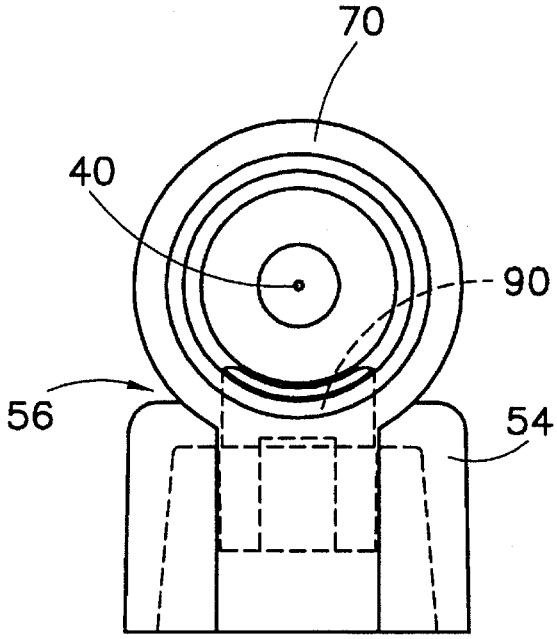
FIG. 9 is an end view of one of the component of FIG. 8.

FIGS. 7–10 illustrate a modified embodiment of the invention. The same reference numerals are used in FIGS. 7–10 as used in FIGS. 1–5 to designate corresponding parts of the two embodiments. A significant difference in the two embodiments resides in the construction of the intermediate link 56. In the FIGS. 7–10 embodiment, the intermediate link 56 is very short compared to the intermediate link 56 of FIGS. 1–5 and can be thought of as extending vertically, as shown in FIGS. 7 and 8, instead of horizontally.

In the FIGS. 7–10 embodiment the support stem 32 and the lug 72 are essentially the same as correspondingly designated parts in the FIGS. 1–5 embodiment. In both embodiments, the intermediate link 56 connects the lug 72 to the support stem 32. In the FIGS. 7–10 embodiment, the intermediate link 56 has a flattened end portion 54 that is mounted for pivotal motion on the support stem 32 to permit rotation about a vertical support axis 42. A clamping screw, or pin 58 is loosened to permit such rotational adjustment and is tightened to clamp parts 56 and 32 together following such rotational adjustment.

The intermediate link 56 has a second flattened portion 70, on which the lug 72 of floodlight housing 12 is pivotally mounted so that the lug can be rotatably adjusted about a horizontal reference axis 40 (FIG. 8). A clamping screw, or pin 84 (FIG. 7) locks together the lug 72 and the intermediate link 56 when the clamping screw 84 is tightened.

In the FIGS. 7–10 embodiment, the above-described rotation of lug 72 about the horizontal axis 40 produces the same vertical adjustment of the floodlight as produced by such rotation in the embodiment of FIGS. 1–5; and the above-described rotation of intermediate link 56 about the vertical axis 42 produces the same horizontal adjustment of the floodlight as produced by such rotation in the embodiment of FIGS. 1–5. In both embodiments, each of these rotational adjustments can be carried out without disturbing the normal horizontal disposition of the quartz-halogen lamp 16.

In the FIGS. 7–10 embodiment, the lug 72, the intermediate link 56, and the support stem 32 are all of a hollow construction that enables them to serve as the components of a wire way through which the power supply wires can be directed. It is noted that the cavities within the flattened portions 70 and 54 are interconnected by a short vertically-extending passage 90 through which the wires pass in extending between these cavities.

In the embodiment of FIGS. 7–10, because the second flattened portion 70 of intermediate link 56 is located directly above the first flattened portion 54 of the link 56, the cavities within these two flattened portions can be interconnected by the short vertical passage 90 (FIG. 8 and 10) which, in effect, is merely an in-line extension of the cavity in flattened portion 54. This relationship enables the intermediate link of FIGS. 7–10 to be manufactured by a simple molding process without requiring any drilling after molding.

More specifically, the cavity within the flattened portion 54 and the passage 90 can be formed during molding by a suitably-shaped one-piece core which is withdrawn after molding by moving the core out of the molding along the axis 42. The cavity within the other flattened portion 70 can be formed during molding by another core (or side pull) which is withdrawn after molding by moving it out of the molding along the axis 40.

The intermediate link 56 of FIGS. 1–5 is not as easy to manufacture as is the case with the intermediate link 56 of FIGS. 7–10. The intermediate link 56 of FIGS. 1–5 can be molded and the cavities in its end portions 52 and 54 formed during the molding process by having suitably shaped cores (or side pulls) in the mold, but the passageway extending along the length of the intermediate link 56 cannot readily be formed during the molding process. After molding this region of the link 56 is of a solid, rather than the desired hollow construction. To produce this hollow, it is necessary, after molding, to drill the link along its longitudinal axis. The link 56 of FIGS. 7–10 can be molded to provide a corresponding passage (90) without the need for such a post-molding drilling operation.

While we have shown and described specific embodiments of our invention, it will be apparent to those skilled in the art that various changes and modifications can be made without departing from our invention in its broader aspects; and we, therefore, intend herein to cover all such changes and modifications as fall within the true spirit and scope of our invention.

What we claim is:

1. A quartz-halogen floodlight comprising:

(a) a lamp housing, (b) a reflector within said housing, (c) socket means for mounting on a substantially horizontal first reference axis within said reflector and a quartz-halogen lamp of the type that comprises (i) an elongated, tubular light-transmitting envelope having a longitudinal axis adapted to extend along said first reference axis and (ii) a filament extending longitudinally of said envelope, (d) mounting structure on the housing that allows the housing to be pivoted about a second reference axis normally disposed substantially horizontally and substantially parallel to said first reference axis, (e) an elongated support stem having a longitudinal axis and means for mounting said support stem on a vertical wall in such a manner that said horizontal axis normally extends substantially horizontally, (f) an intermediate link between said support stem and said mounting structure, (g) means for mounting said intermediate link on said support stem for pivotal motion about a support axis that extends substantially vertically and perpendicular to said longitudinal axis of said support stem, (h) means for mounting said mounting structure on said intermediate link for pivotal motion about said second reference axis and so that said second reference axis extends substantially perpendicular to said support axis, (i) pin means for fixing said intermediate link in a predetermined position of adjustment with respect to said support stem following pivotal motion of said intermediate link about said support axis, (j) means for fixing said mounting structure in a predetermined position of adjustment with respect to said intermediate link following pivotal motion of said mounting structure about said second reference axis, and wherein:

(k) said floodlight is constructed to allow for both vertical and horizontal motion of said first reference axis while blocking any shifting of said first reference axis out of a horizontal orientation, (l) said intermediate link has two end portions at its respective opposite ends located immediately adjacent each other, (m) one of said end portions is pivotally mounted on said support stem for rotational motion about said support axis, (n) said mounting structure is pivotally mounted on the other of said end portions for rotational movement about said second reference axis, (o) said intermediate link includes a short wire-way passage that extends between cavities in said end portions, said wire-way passage extending substantially parallel to said support axis, (p) said intermediate link is a molded component made by a molding process, (q) said short wire-way passage and the cavity in one of said end portions are made during molding by the presence of a core in the space occupied by said passage and said cavity, and (r) said core can be withdrawn from said space after molding by moving said core out of the molded component substantially parallel to said support axis.

2. A lighting arrangement comprising:

(A) a vertically extending wall, (B) a quartz-halogen floodlight comprising:

(a) a lamp housing, (b) a reflector within said housing, (c) socket means for mounting on a substantially horizontal first reference axis within said reflector and a quartz-halogen lamp of the type that comprises (i) an elongated, tubular light-transmitting envelope having a longitudinal axis adapted to extend along said first reference axis and (ii) a filament extending longitudinally of said envelope, (d) mounting structure on the housing that allows the housing to be pivoted about a second reference axis normally disposed substantially horizontally and substantially parallel to said first reference axis, (e) an elongated support stem secured to said wall and having a longitudinal axis that is normally disposed substantially horizontally, (f) an intermediate link between said support stem and said mounting structure, (g) means for mounting said intermediate link on said support stem for pivotal motion about a support axis that extends substantially vertically and perpendicular to said longitudinal axis of said support stem, (h) means for mounting said mounting structure on said intermediate link for pivotal motion about said second reference axis and so that said second reference axis extends substantially perpendicular to said support axis, (i) pin means for fixing said intermediate link in a predetermined position of adjustment with respect to said support stem following pivotal motion of said intermediate link about said support axis, and (j) means for fixing said mounting structure in a predetermined position of adjustment with respect to said intermediate link following pivotal motion of said mounting structure about said second reference axis, and wherein:

(k) said lighting arrangement is constructed to allow for both vertical and horizontal motion of said first reference axis while blocking any shifting of said first reference axis out of a horizontal orientation.

(l) said intermediate link has two end portions at its respective opposite ends, (m) one of said end portions is pivotally mounted on said support stem for rotational motion about said support axis, (n) said mounting structure is pivotally mounted on the other of said end portions for rotational movement about said second reference axis, (o) said two end portions are located immediately adjacent each other, and (p) said intermediate link includes a short wire-way passage that extends between cavities in said end portions, said wire-way passage extending substantially parallel to said support axis.

3. The lighting arrangement of claim 2 in which:

(a) said intermediate link is a molded component made by a molding process, (b) said short wire-way passage and the cavity in one of said end portions are made during molding by the presence of a core in the space occupied by said passage and said cavity, and (c) said core can be withdrawn from said space after molding by moving said core out of the molded component substantially parallel to said support axis.

* * * * *